US005281115A

United States Patent [19]

Timuska

[11] Patent Number: 5,281,115

[45] Date of Patent: Jan. 25, 1994

[54] ROTARY SCREW MACHINE HAVING THRUST BALANCING MEANS

[75] Inventor: Karlis Timuska, Spanga, Sweden

[73] Assignee: Svenska Rotor Maskiner AB, Stockholm, Sweden

[21] Appl. No.: 890,600

[22] PCT Filed: Jan. 30, 1991

[86] PCT No.: PCT/SE91/00067

§ 371 Date: Jul. 7, 1992

§ 102(e) Date: Jul. 7, 1992

[87] PCT Pub. No.: WO91/12432

PCT Pub. Date: Aug. 22, 1991

[30] Foreign Application Priority Data

Feb. 9, 1990 [SE] Sweden ..... 9000473

[51] Int. Cl.[5] ..... F01C 1/16; F01C 21/02; F01C 18/16; F01C 23/00

[52] U.S. Cl. ..... 418/9; 418/203

[58] Field of Search ..... 418/9, 203

[56] References Cited

U.S. PATENT DOCUMENTS 3,388,854 6/1968 Olofsson et al. ..... 418/203

3,947,078 3/1976 Olsaker ..... 418/203

FOREIGN PATENT DOCUMENTS 2169361 7/1986 United Kingdom ..... 418/203

*Primary Examiner*—John J. Vrablik

*Attorney, Agent, or Firm*—Frishauf, Holtz, Goodman & Woodward

[57] ABSTRACT

The invention relates to a rotary screw machine in which the shaft journals (20, 22) of the rotors (10) are journalled in a main thrust bearing (24) and a thrust balancing bearing (26). The thrust balancing bearing (26) is preloaded by springs (36) and by fluid pressure means (40, 44). According to the invention the fluid pressure means (40, 44) can excert a force on the thrust balancing bearing (26) in either axial direction. This increases the possibility for an optimal distribution of the forces on the thrust bearings (24, 26) at various running conditions.

7 Claims, 2 Drawing Sheets

ROTARY SCREW MACHINE HAVING THRUST BALANCING MEANS

BACKGROUND OF THE INVENTION

The present invention relates to a rotary screw machine having at least one pair of rotors which are affected by forces from the working fluid in a first axial direction, at least one of the rotors being provided with shaft journals supported by bearing means, including main thrust bearing means and thrust balancing bearing means having a rotating ring and a stationary ring and being provided with thrust balancing means, said thrust balancing means including spring means acting on said stationary ring in said first direction and fluid pressure means acting axially on said stationary ring.

A compressor of this kind is known from U.S. Pat. No. 3,388,854. In that disclosure, the stationary ring of the thrust balancing bearing is pre-loaded by a spring 35 acting in the same direction as the axial gas forces on the rotors. The stationary ring also abuts a fluid actuated piston 36, through which a force can be applied to the ring counteracting the force from the spring. The pressure chamber 37, through which a pressure can be applied to the piston 36 can be connected to a pressure source, i.e. the outlet channel. This is the case under normal operating conditions, whereby the thrust load will be distributed to the thrust bearings on both ends of the rotor. When the compressor is idling, the pressure chamber is relieved to the atmosphere so that only the spring pre-loads the stationary ring. Through this known device, in many cases, a satisfactory distribution of the axial forces on the thrust bearings is attained, but it entails still some limitations regarding an optimal distribution of these forces.

The object of the present invention is to improve the known thrust balancing device in order to reach such a force distribution on the thrust bearings so that the resultant force on each thrust bearing falls within a more narrow range, thereby increasing the possibility to meet the requirements for a sufficient working life for each of the thrust bearings.

SUMMARY OF THE INVENTION

According to the present invention, this object has been attained in that a device of this kind is provided with means for regulating the axial direction of the force exerted by the fluid pressure means.

Each thrust bearing has to be loaded within a certain range, where the maximum force is determined by the working life of the bearing, and the minimum force has to be large enough to avoid sliding of the bearing balls in the rings. With a balancing device according to the invention, the possibilities to attain a force distribution for the bearings so that the force on each bearing falls within this range, will increase due to the fact that the force on the stationary ring of the thrust balancing bearing can be either the sum of the fluid pressure force and the spring force, the spring force along or the difference between the fluid pressure force and the spring force. By having these different alternatives for loading the stationary ring of the thrust balancing bearing, it will be possible to adapt this loading to the different running conditions of the machine; starting, idling, working at low pressure and working at full pressure. During these various running conditions, the external axial force on the rotors, comprised mainly by forces from the pressure of the working fluid but also by forces from driving and timing gears, are of different strength.

With the earlier known technique, where the fluid pressure force on the outer ring either is zero or acts contrary to the spring force, the possibility to adapt the loading of the ring to the various running conditions are more limited, and with that the possibility to keep the forces within the prescribed ranges.

The fluid pressure means preferably takes the form of a pressure chamber, the pressure of which acts on a surface on the stationary ring. The regulating means selectively connects the pressure chamber with either overpressure, atmospheric pressure or underpressure. The machine is particularly intended to be used as a compressor, in which case the overpressure source preferably is the outlet channel thereof and the atmospheric pressure source as well as the underpressure source is the inlet channel.

In a preferred embodiment the means for selectively connecting the pressure chamber with a fluid pressure source includes a two-way valve regulated by the outlet pressure of the compressor and connecting the chamber either with the outlet channel or the inlet channel of the compressor. These means preferably also include variable throttling means in the inlet channel of the compressor.

It might be convenient to fix the stationary ring in an axially movable member through which the spring force and the fluid pressure force are transmitted to the ring.

The invention can advantageously be applied to a multistage compressor, in which case the high pressure source can be the flow path of the working fluid at a point anywhere between the outlet port of the first stage and the outlet port of the last stage, preferably in the inlet channel of any of the stages later than the first stage.

The invention will be explained through the following detailed description of a preferred embodiment thereof and with reference to the accompanying drawing showing a schematic section through the male rotor of a compressor according to the invention. Details of the compressor not being essential for the understanding of the invention are omitted from the drawing for the sake of clarity.

DETAILED DESCRIPTION

Figure 1:
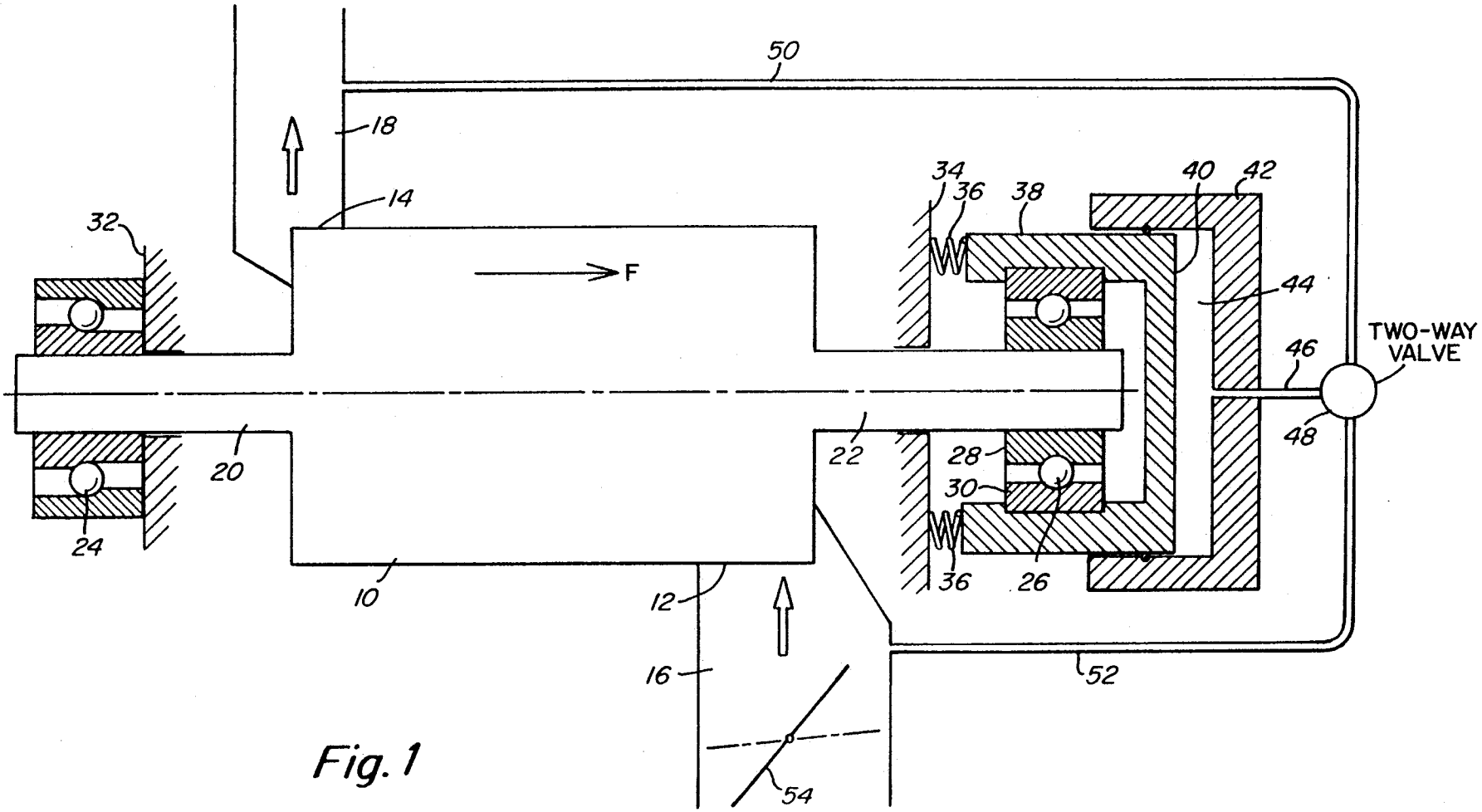
FIG. 1 shows a schematic section through the male rotor of a compressor according to the present invention.
Figure 2:
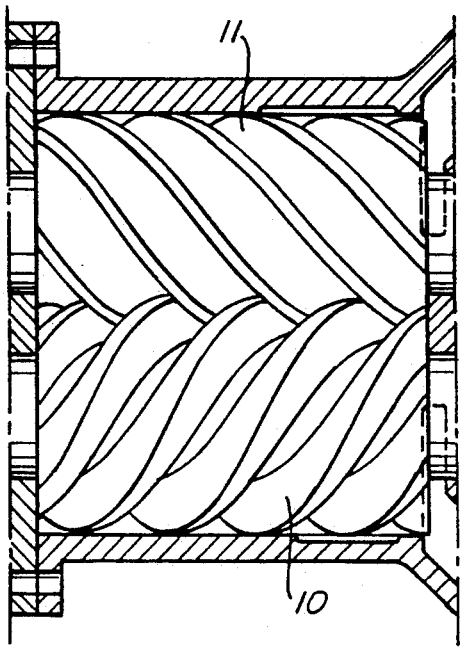
FIG. 2 shows a pair of screw rotors of the compressor according to the present invention.

In FIG. 1, 10 represents the male rotor of a rotary screw machine. The male rotor cooperates with a female rotor (as shown in FIG. 2) through helical lobes and grooves on the rotors in a manner well-known. Through chevron-shaped working chambers formed by the rotors and the surrounding casing, a gaseous fluid, e.g. air, is compressed. The air is supplied to the compressor from an inlet channel 16 through an inlet port 12, and the compressed air leaves the compressor through an outlet port 14 to an outlet channel 18.

The rotor 10 is provided with shaft extensions or shaft journals 20, 22 at its ends, through which the rotor is journalled in thrust bearings 24, 26. Elements like journal bearings, shaft sealings, driving connection and timing gears normally also are present, but in order to elucidate the invention they are left out from FIG. 1.

The arrow F represents the external axial force acting on the rotor 10 during operation. This force normally is directed to the right in FIG. 1, i.e. towards the low pressure end of the compressor, which is defined as the positive direction. The force F comprises the force acting on the rotor due to the pressure difference between the high pressure end and the low pressure end of the compressor and the forces coming from the driving and timing gears. The force due to the pressure difference normally is dominating and is always in the positive direction. The resultant of the forces from the driving and timing gears acts in the negative direction, but since this force is much smaller, the total force F normally is positive.

The external axial force F is taken up by a main thrust bearing 24 at the high pressure end and a thrust balancing bearing 26 at the low pressure end. The main thrust bearing 24 abuts a part 32 of the casing and is capable of taking up forces in the positive direction.

The thrust balancing bearing 26 has its stationary ring 30 fixed in an axially movable member 38. Although shown as a single unit, the member 38 is comprised of two parts to make the assembly possible. Springs 36 supported by a part 34 of the casing act on member 38 with a force in the positive direction. Also acting on the member 38 is fluid pressure within a sealed chamber 44. The fluid pressure in this chamber 44 acts on a pressure surface 40 of the member 38, and if the pressure in the chamber 44 is above atmospheric pressure, a force in the negative direction occurs which thus counteracts the force from the springs 36. If the pressure in the chamber 44 is below atmospheric pressure a suction effect on the member 38 is attained since the pressure on the other side thereof always is about atmospheric pressure. In this case the fluid pressure force on the member 38 will be in the positive direction, i.e. in the same direction as the force coming from the springs 36. If the pressure in the chamber 44 is of atmospheric pressure, only the spring force will pre-load the stationary ring 30. Through a connection pipe 46 and a two-way valve 48 the chamber 44 can be connected either with the outlet channel 18 through a pipe 50 or with the inlet channel 16 through a pipe 52. The position of the two-way valve 48 is regulated by means sensing the outlet pressure. By means of a throttle valve 54 in the inlet channel 16, the incoming air can be throttled, whereby underpressure will develop in the inlet channel 16 downstream of the throttle valve 54.

For a certain thrust ball bearing there exists a maximum force $F_{max}$ that can be allowed with respect to its running life. There is also a minimum force $F_{min}$ required in order to avoid sliding of the balls in the races. The range $F_{min}$ to $F_{max}$ thus determines the allowable force on the thrust bearing.

How the described device makes it possible to distribute the axial forces to the main thrust bearing 24 and the thrust balancing bearing 26 so that the force on each of them will remain within the allowable range at different running conditions will be explained by the following example.

The bearing used for the main thrust bearing 24 has a $F_{min}=1100$ N and a $F_{max}=1800$ N, and the corresponding valves for the thrust balancing bearing are 300 N and 800 N, respectively. The main thrust bearing 24 is capable of taking up forces in the positive direction, whereas the thrust balancing bearing 26 is of a kind allowing load in either direction. The total spring force, $F_S$ is 400 N.

At idling, the throttle valve 54 is in its closed position (shown by broken lines in the figure) thereby creating an underpressure inlet condition. The pressure at the outlet will be about atmospheric. At this operating conditon the external force on the rotor was 422 N in the positive direction. The two-way valve 48 is in a position where the sealed chamber 44 is connected to the inlet channel 16 downstream of the throttle 54. Since the underpressure in the inlet channel thereby is transmitted to the sealed chamber 44, there will be a suction force on the movable member 38, which means that the direction of the force is positive. This force, $F_B$ will be 316 N. The total axial load on the thrust balancing bearing 26, $F_{TB}$ coming from the spring force and the force from the underpressure thus will be $400+316=716$ N. The load on the main thrust bearing 24, $F_T$ will be the sum of the external force and the resultant force on the thrust balancing bearing 26, with which are positive. Thus, $F_T=422+716=1138$ N.

When the compressor is loaded, the throttle 54 is set in its open position. When working at a certain low delivery pressure the external force, F was found to be 1280 N. Also under this working condition the valve 48 connects the sealed chamber 44 to the inlet channel 16. Since the pressure in the inlet channel 16 now is about atmospheric pressure, there will be neither over- nor underpressure acting on the pressure surface 40 of the movable member 38. Consequently the only force exerted on the thrust balancing bearing 26 will be that from the springs 36, $F_S=400$ N. The load on the main thrust bearing 24 thus will be $1280+400=1680$ N.

When working at full delivery pressure, the external force F, was found to be 2248 N. In this case the two-way valve 48 is in a position connecting the sealed chamber 44 to the outlet channel 18, so that overpressure will prevail in the sealed chamber. This creates a force of 892 N in the negative direction on the member 38, which is counteracting the force from the springs 36. Consequently there will be a load on the thrust balancing bearing 26 in the negative direction amounting to $F_B-F_S=892-400=492$ N. The load on the main thrust bearing 24 therefore will be $2242-492=1750$ N.

The different forces occurred in the above described example are put together in the table below:

| | unloaded | low del. pressure | full del. pressure |
|---|---|---|---|
| F | 422 | 1280 | 2242 |
| $F_B$ | 3.16 | 0 | −892 |
| $F_S$ | 400 | 400 | 400 |
| $F_{TB}$ | 716 | 400 | −492 |
| $F_T$ | −1138 | −1680 | −1750 |

As can be seen from the table, the forces on the thrust bearings $F_{TB}$ and $F_T$ all the time will be within the allowed range 300–800 N and 1100–1800 N, respectively. This is a direct consequence of the invention, making it possible to attain a force from the fluid pressure means which cannot only be zero or directed in a first direction, but also in a second direction. Without introducing the latter feature, this could not be achieved.

Figure 3:
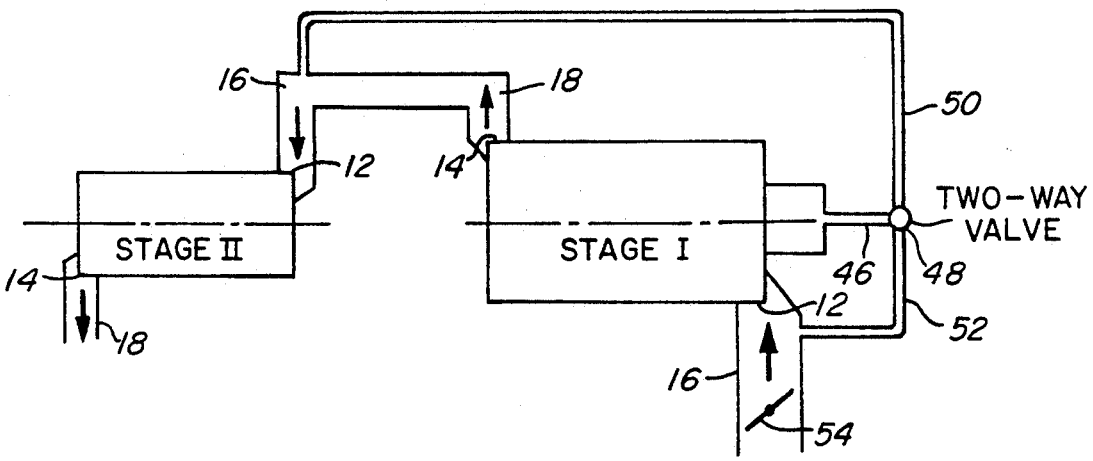
FIG. 3 is a block diagram illustrating the present invention as applied to a two-stage compressor.

As shown in FIG. 3, the invention can be applied to a multi-stage compressor, each stage containing one pair of rotors, wherein the fluid pressure source having a pressure above atmospheric pressure is the flow path of the working fluid in a point anywhere between the outlet port 14 of the first stage (stage I) and the outlet port of the last stage (stage II). In a preferred arrangement, the point is located in the inlet channel 16 of any stage later than the first stage. The chamber 46 is selectively connected with a fluid pressure source by means of the two-way valve 48 regulated by the outlet pressure of the first stage (stage I) of the multi-stage compressor, and the variable throttling means 54 in the inlet channel (16) of the first stage of the multi-stage compressor.

I claim:

1. A rotary screw machine comprising:

a casing;

at least one pair of rotors arranged in said casing and being subject to forces from a working fluid in a first axial direction of said rotors;

shaft journals provided on at least one of said rotors;

bearing means for supporting said shaft journals relative to said casing, said bearing means including main thrust bearing means and a thrust balancing bearing means;

said thrust balancing bearing means including a rotating ring and a stationary ring and being provided with thrust balancing means, said thrust balancing means including spring means acting on said stationary ring in said first axial direction and fluid pressure means for acting axially on said stationary ring, said fluid pressure means including a sealed chamber and a surface, facing said sealed chamber, said surface being defined on a member rigidly connected to said stationary ring; and regulating means including means for selectively connecting said sealed chamber with a fluid pressure source having a pressure above atmospheric pressure, at atmospheric pressure, or below atmospheric pressure.

2. The rotary screw machine according to claim 1, operating as a compressor, further comprising:

an inlet channel provided with a variable throttling device therein; and an outlet channel;

wherein said fluid pressure source having a pressure above atmospheric pressure comprises said outlet channel;

wherein said fluid pressure source having atmospheric pressure comprises a portion of said inlet channel downstream of said variable throttling device; and wherein said fluid pressure source having a pressure below atmospheric pressure comprises a portion of said inlet channel downstream of said variable throttling device.

3. The rotary screw machine according to claim 2, operating as a compressor, wherein said regulating means for selectively connecting said sealed chamber with a fluid pressure source includes a two-way valve regulated by an outlet pressure of the compressor and connecting said sealed chamber with one of said outlet channel and said inlet channel of the compressor.

4. The rotary screw machine according to claim 1, comprising a plurality of pairs of rotors, each pair of rotors operating as a stage in a multi-stage compressor, wherein said fluid pressure source having a pressure above atmospheric pressure comprises a flow path of the working fluid at a point between an outlet port of a first stage and the outlet port of a last stage of said multi-stage compressor.

5. The rotary screw machine according to claim 4, wherein said fluid pressure source having a pressure above atmospheric pressure comprises a flow path of the working fluid at a point located in an inlet channel of any stage later than the first stage of said multi-stage compressor.

6. The rotary screw machine according to claim 5, wherein said regulating means for selectively connecting said sealed chamber with a fluid pressure source includes:

a two-way valve regulated by an outlet pressure of the first stage of said multi-stage compressor; and a variable throttling device in the inlet channel of said multi-stage compressor.

7. The rotary screw machine according to claim 4, wherein said regulating means for selectively connecting said sealed chamber with a fluid pressure source includes:

a two-way valve regulated by an outlet pressure of a first stage of said multi-stage compressor; and a variable throttling device in an inlet channel of said multi-stage compressor.

* * * * *